US005265801A

United States Patent [19]

Larson

[11] Patent Number: 5,265,801

[45] Date of Patent: Nov. 30, 1993

[54] VORTEX TUBE USED TO SUPPLY LPHV AIR TO SPRAY APPARATUS

[75] Inventor: John C. Larson, Clarkston, Mich.

[73] Assignee: E. I. Du Pont de Nemours and Company, Wilmington, Del.

[21] Appl. No.: 707,991

[22] Filed: May 23, 1991

Related U.S. Application Data

[63] Continuation of Ser. No. 305,441, Feb. 2, 1989, abandoned.

[51] Int. Cl.[5] ..... B05B 1/24; B05B 7/02; B05B 7/10

[52] U.S. Cl. ..... 239/11; 239/13; 239/135; 239/290; 62/5

[58] Field of Search ..... 239/1, 8, 11, 13, 290, 239/340, 364, 365, 135; 118/300; 427/421; 62/5

[56] References Cited

U.S. PATENT DOCUMENTS

| | | | |
|---|---|---|---|
| 3,019,621 | 2/1962 | Lawson | 62/5 X |
| 3,208,229 | 9/1965 | Fulton | 62/5 |
| 3,214,923 | 11/1965 | Palmisano et al. | 62/5 |
| 3,336,463 | 8/1967 | Johnson | 239/135 X |
| 3,884,819 | 5/1975 | Shultz et al. | 62/5 X |
| 4,240,261 | 12/1980 | Inglis | 62/5 |
| 4,333,754 | 6/1982 | Peter | 62/5 |
| 4,339,926 | 7/1982 | Moretti et al. | 62/5 |
| 4,767,056 | 8/1988 | Demetrius et al. | 239/290 X |
| 4,964,569 | 10/1990 | Stevens | 239/13 |

FOREIGN PATENT DOCUMENTS 0803984 2/1981 U.S.S.R. .

*Primary Examiner*—Andres Kashnikow
*Assistant Examiner*—William Grant
*Attorney, Agent, or Firm*—Chris P. Konkol

[57] ABSTRACT

A method of spraying a coating onto a substrate using low pressure, high volume air is disclosed. More specifically, the step of using a vortex tube with valves at both the hot and cold air discharge ends to supply the low pressure, high volume air to a spray gun is disclosed. The use of the vortex tube results in an inexpensive system, that can be used in electrically hazardous areas, and allows very precise control of air temperature.

12 Claims, 2 Drawing Sheets

VORTEX TUBE USED TO SUPPLY LPHV AIR TO SPRAY APPARATUS

This application is a continuation of application Ser. No. 07/305,441 filed Feb. 2, 1989, now abandoned.

FIELD OF THE INVENTION

This invention relates to the use of a vortex tube to supply low pressure, high volume (LPHV) air to a spray apparatus to be used in the spray application of coatings.

BACKGROUND

The application of coatings onto various substrates by the use of spray guns is well known in the prior art. This spraying typically has been accomplished in several different ways, including the following: (1) conventional air atomized; (2) airless spray (high pressure fluid through an orifice); (3) air assisted (a combination of (1) and (2)); and (4) low pressure, high volume (LPHV) air. LPHV air (also known in the industry as high volume, low pressure (HVLP) air) is normally less than 15 psig at a temperature well in excess of the ambient temperature. The term LPHV air as used in this application shall mean any warm air supply to a spray gun which has lower pressure than that found in conventional air atomized spraying or air assisted spraying. The LPHV route to atomize the coating is gaining increasing acceptance over the other methods because of the following potential advantages: (1) higher transfer efficiency because of the low atomizing pressure minimizing overspray and and bounceback; (2) improved spray quality because the spray pattern can be precisely controlled; (3) the soft delivery prevents paint from being forced under masks; (4) the warm air is especially beneficial for atomizing high-solids paint; (5) the low pressure arrangement produces small particle sizes and is less prone to disturb the relationship of solvent to pigment-/binder; (6) the laminar style flow provides a confined pattern that can effectively penetrate into hard to reach areas; (7) spray areas are cleaner because of better spray efficiency; and (8) the ability to drastically lower the air volume and pressure in order to do excellent texture finishes.

In the past, there have been two basic methods of supplying LPHV air to a spray gun in order to atomize the coating. The most common method is the turbine. In fact LPHV spraying is alternately called "turbine spraying". Turbine spraying uses a high performance turbine/compressor which intakes filtered ambient air and creates warm LPHV air. (The heating of the air stream is a natural byproduct of high performance turbines). The second LPHV method involves a compressed air "conversion unit". This is simply a common pressure regulator that reduces the compressed air pressure down to 5–15 psig. This low pressure air is then heated to approximately 100°–200° F. by means of an electric resistance heater.

Both of the above-mentioned LPHV methods have certain drawbacks. For instance the turbine method has moving parts that can break down and that require occasional maintenance. It also requires electrical power to operate which must be explosion proof for electrically hazardous classified areas. Also the control of air temperature is not precise with turbines. In most cases the temperature is only controlled by the length of air hose connected between the turbine and the spray gun. And, the initial capital costs are relatively high for a turbine system. Likewise the compressed air conversion unit suffers from similar drawbacks. The temperature control on these units is effected by the use of a thermostat utilizing on-off control and resulting in significant temperature cycling. In order to make this type of unit suitable for electrically hazardous areas expensive purging or an expensive explosion proof mounting box would be required.

What is needed is a source of LPHV air for paint spray guns which is inexpensive, requires little mainainence, has simple and precise temperature adjustment and is explosion proof.

DETAILED DESCRIPTION OF THE INVENTION

Figure 1:
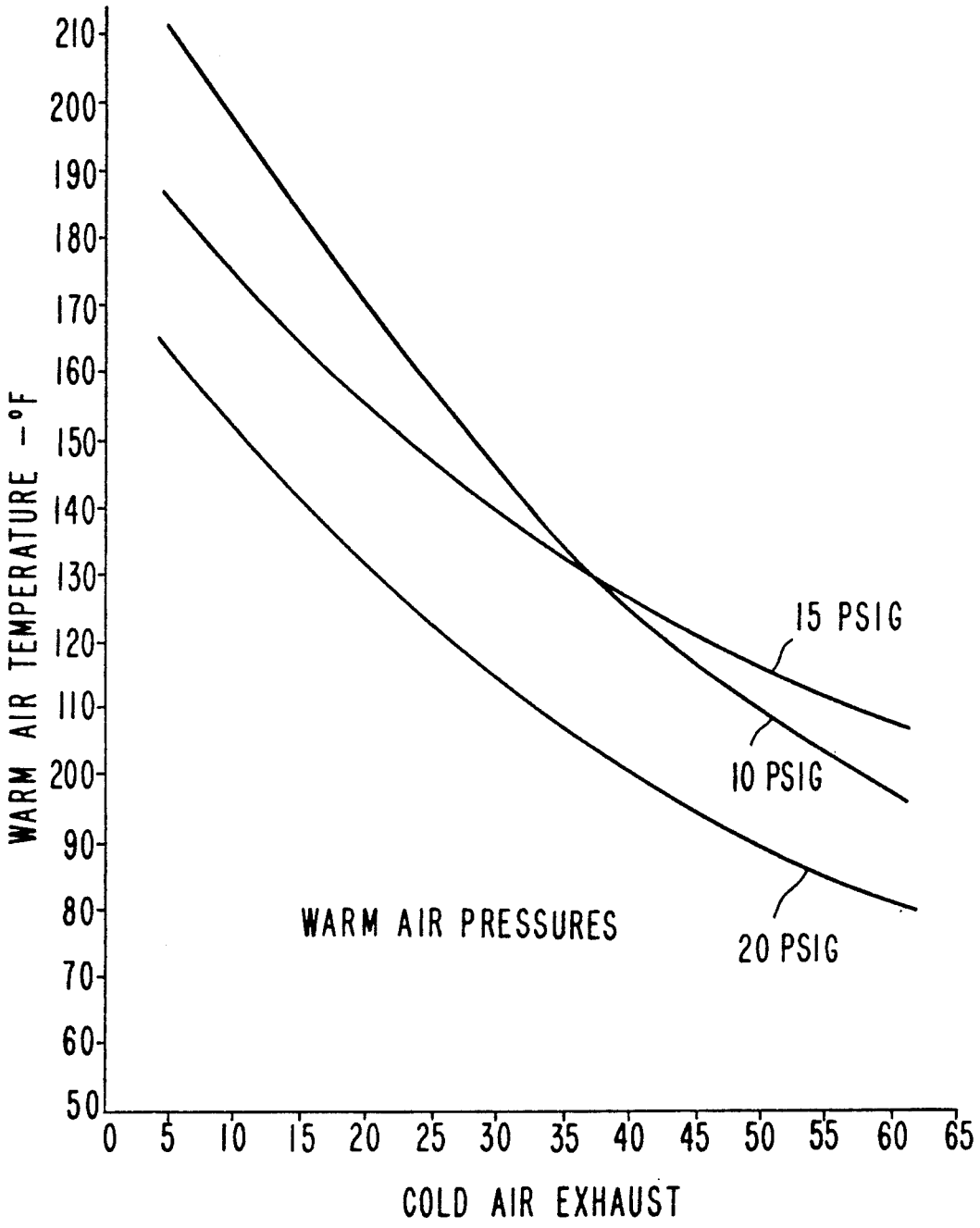
FIG. 1 shows the relationship between the warm air temperature and cold air pressure for various warm air pressures using 80 psig supply air to a Vortec Model 328-75-H vortex tube.

We have found that the use of a vortex tube as a supply of LPHV air for spraying operations is the equivalent of the turbine method and compressed air conversion method in most respects and is clearly superior in others.

Vortex tubes are well known in the prior art and have a number of different industrial cooling applications. The vortex tube is a low cost, reliable, maintenance free tube which using an ordinary supply of compressed air as a power source creates two streams of air, one hot and one cold. Vortex tubes can produce temperatures ranging from −40° F. to more than 200° F.; flow rates ranging from 1 to 100 SCFM and refrigeration up to 6000 BTU/hr. Furthermore, temperatures and air flows are adjustable over a wide range using a control valve on the warm end exhaust.

The vortex tube works by injecting compressed air (typically 80–100 psig) tangentially into the vortex spin chamber. At more than 500,000 RPM, this air stream revolves toward the hot end where some escapes through the control valve. The remaining air, still spinning, is forced back through the center of this outer vortex. The inner stream gives off kinetic energy in the form of heat to the outer stream and exits the vortex tube as cold air. The outer stream exits the other end as hot air.

The use of vortex tubes has been used in the past for a variety of industrial spot cooling problems. However, the hot air exhaust side of the vortex tube has not typically been used in the past. In fact we are aware of no exclusive commercial use of the warm air exhaust from a vortex tube. Further, there are no prior art references which show or suggest the use of vortex tubes as LPHV warm air sources for spray guns.

Vortex tubes are available commercially from several companies including Vortec Corporation and Exair Corporation. In order to determine the optimum operating conditions for a specific spray application it would be necessary to experiment with various warm air pressures, flow rates and temperatures. These variables can be modified by either using different size vortex tubes, adjusting the warm air exhaust valve or changing the cold air passage diameter on the same vortex tube.

Our experimental work thus far has been on high solids automotive refinish paints such as Imron ® 5000 from DuPont. (Although the invention is capable of being utilized with any coating which can be sprayed). Of the commercially available, "off the shelf" vortex tubes we have found that for our purposes the best vortex tube is the Model 328-75-H available from Vortec Corporation. Smaller vortex tubes did not provide high enough temperature, pressure and flow. And larger vortex tubes consumed excessive compressed air and provided temperature, pressure and flow which were in excess of what was required in a one spray gun process. The preferred spray gun was found to be the DeVillbis Model JGHV-501. However, it will be apparent to one skilled in the art that any of a number of commercially available spray guns could be used depending upon the specific application. In fact this invention could be potentially utilized in any spray application.

The Model 328-75-H supplies warm air within the parameters shown in FIG. 1. We have found that for Imron ® 5000 paint sprayed with the DeVillbis Model JGHV-501 spray gun the optimum warm air supply to the spray gun is 17–18 SCFM at 13–15 psig. The optimum temperature of the air exiting the spray gun is 95° F.–105° F. These conditions optimize film appearance and spray transfer efficiency.

Figure 2:
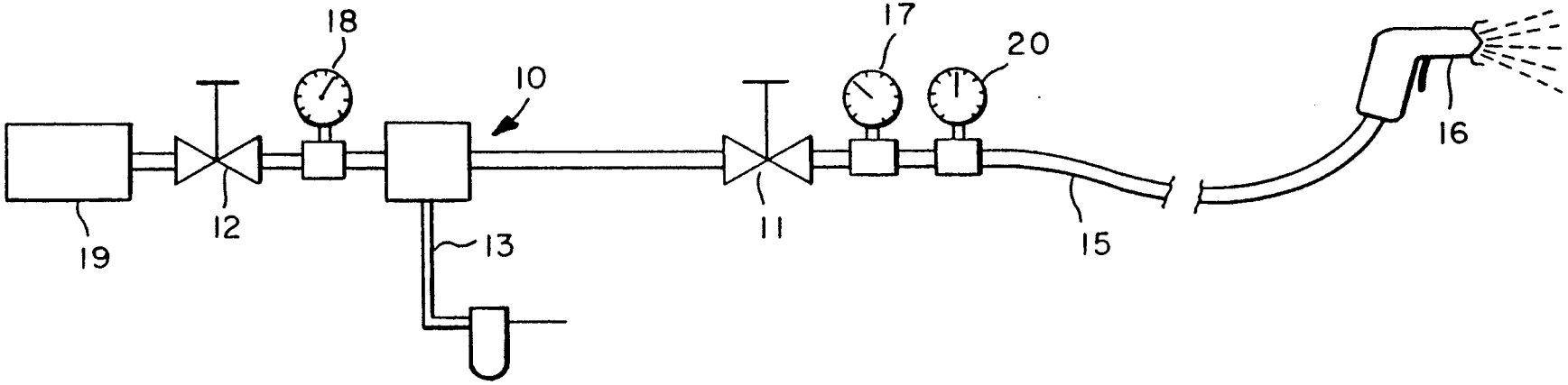
FIG. 2 shows a schematic of a vortex tube connected to a spray gun.

FIG. 2 shows a schematic of vortex tube 10 connected to spray gun 16. The warm air pressure is varied by adjusting warm air control valve 11 (which is normally included as an integral part of the purchased vortex tube). The warm air temperature is varied by adjusting cold air pressure valve 12. Note: adjustments to either valve can influence the parameter controlled by the opposite valve and thus concurrent "fine tuning" of both valves may be necessary. Cold air pressure valve 12 is not found on vortex tubes bought off the shelf and therefore must be installed by adding pipe fittings to the cold end of the vortex tube. It will be apparent to one skilled in the art how to add such pipe fittings. It may also be desirable to have a pressure gauge 18 before valve 12 and a muffler 19 on the cold air exhaust.

The vortex tube is connected to compressed air line 13 which includes air filter 14 to filter out possible contaminants such as dirt and oil. The air in line 13 is between 60–100 psig. The warm air side of the tube is connected with an appropriate flexible hose 15 to LPHV spray gun 16. It may also be desirable to install a warm air pressure gauge 17 and a warm air temperature gauge 20 between valve 11 and spray gun 16. It is also quite possible that future LPHV spray guns might be designed such that the vortex tube is an integral part of the gun itself. In addition it is foreseeable that the warm LPHV air might be used to heat the paint prior to atomization. The increased paint temperature lowers the viscosity which could result in the ability to use higher solids, low VOC paint without loss in coating quality. It is also conceivable that the LPHV warm air supply could be used purely as a carrier and shaper of paint spray which has been atomized by other methods (e.g. electrostatic, ultrasonic, or centrifugal).

One important characteristic of the vortex tube is the fact that temperature can be readily controlled to within 2° F. In contrast the temperature variation in the compressed air converter is typically only within 10–15° F. and the temperature with the turbine method is typically adjustable only by adding or removing lengths of hose, which is less than precise.

Another important advantage which is obtained by using the vortex tube is that of initial cost. Its simplicity and the fact that it can be used in electrically hazardous areas, as is, makes the cost of it much less than that equipment used in other methods for supplying warm air to LPHV spray guns. In addition, the vortex tube method only requires a utility (compressed air) that is already installed at sufficient capacity in most of the companies that are involved in spray application of coatings.

EXAMPLE

An experiment was run using a Vortec 328-75-H vortex tube configured as shown in FIG. 2 above. The spray gun utilized was a DeVillbis Model JGHV-501. The adjusting valves on the vortex tube were adjusted so that the warm air supply to the spray gun was at about 15 psig, about 100° F. and 17–18 SCFM. With a consistent compressed air supply it was easy to control the temperature within 2° F. once a steady state was found.

The paint sprayed was DuPont's Imron ® 5000 high solids refinish paint. Various size panels were hand sprayed from a gun distance of 10–12 inches, and a gun speed of 3–4 feet per second. No problems were found with gun surface temperature as can be found with a turbine system. Some sprayed panels were ambient cured and others were oven cured. The finished panels were evaluated visually and were found to be equal to or better than conventional air atomized panels in terms of appearance and film build.

I claim:

1. A method for spraying a coating material onto a substrate using warm air to atomize the coating, the improvement which comprises using a vortex tube to supply warm air to a means for spraying the coating material, said vortex tube having a vortex spin chamber into which compressed air is injected to produce a a relatively warm air stream at one end of the vortex tube and a relatively cold air stream at the other end of the vortex tube, and wherein a means for varying the warm air pressure and a means for varying the cold air pressure are both adjusted to obtain a desired temperature and pressure for the warm air supplied to a means for spraying the coating material.

2. The method of claim 1, wherein said means for spraying the coating material is a spray gun.

3. The method of claim 1, wherein the coating material is a paint.

4. The method of claim 3, wherein the paint is a high solids refinish paint.

5. The method of claim 1, wherein the pressure of the warm air supplied to the means for spraying is less than 15 psig.

6. The method of claim 1, wherein the the means for varying the cold air pressure is a valve on the cold air stream from the vortex tube.

7. The method of claim 1, wherein the means for varying the warm air pressure supplied to the means for spraying is a valve on the warm air stream from the vortex tube.

8. The method of claim 1, wherein the temperature of the air exiting the spray gun is 95° F. to 105° F.

9. The method of claim 1, wherein the warm air pressure is obtained by adjusting said means for varying the warm air pressure and the warm air temperature is obtained by adjusting the means for varying the cold air pressure.

10. The method of claim 1, wherein the pressure of the warm air and cold air stream from the vortex tube is measured by a pressure gauge.

11. The method of claim 1, wherein the temperature of the warm air is measured by a temperature gauge.

12. The method of claim 1, wherein the cold air exhaust is passed through a muffler.

* * * * *